US005204890A

United States Patent [19]

Anno et al.

[11] Patent Number: 5,204,890

[45] Date of Patent: Apr. 20, 1993

[54] ROTARY ANODE TYPE X-RAY TUBE

[75] Inventors: Hidero Anno, Ootawara; Katsuhiro Ono, Utsunomiya; Hiroyuki Sugiura, Ootawara; Takayuki Kitami, Tochigi; Hideo Yagoshi; Murashi Shinto, both of Ootawara, all of Japan

[73] Assignee: Kabushiki Kaisha Toshiba, Kawasaki, Japan

[21] Appl. No.: 767,615

[22] Filed: Sep. 30, 1991

[30] Foreign Application Priority Data

Oct. 1, 1990 [JP] Japan ..... 2-263335
Feb. 8, 1991 [JP] Japan ..... 3-17578
Aug. 21, 1991 [JP] Japan ..... 3-209406

[51] Int. Cl.[5] ..... H01J 35/10

[52] U.S. Cl. ..... 378/133; 378/125; 378/132

[58] Field of Search ..... 378/119, 125, 132, 133, 378/144; 384/132, 292, 241, 286, 322, 397, 368

[56] References Cited

U.S. PATENT DOCUMENTS

| | | | |
|---|---|---|---|
| 3,720,853 | 3/1973 | Atlee et al. | 378/133 |
| 4,210,371 | 7/1980 | Gerkema et al. . | |
| 4,562,587 | 12/1985 | Gerkema et al. . | |
| 4,641,332 | 2/1987 | Gerkema | 378/133 |
| 4,856,039 | 8/1989 | Roelandse et al. . | |
| 4,914,684 | 4/1990 | Upadhya | 378/133 |
| 5,068,885 | 11/1991 | Vetter | 378/133 |
| 5,077,776 | 12/1991 | Vetter | 378/133 |

*Primary Examiner*—David P. Porta
*Attorney, Agent, or Firm*—Cushman, Darby & Cushman

[57] ABSTRACT

A rotary X-ray tube of the anode type wherein at least one of bearing surfaces which are partly formed on rotary and stationary structures is made of ceramics whose main component is the nitride, boride or carbide of at least one of those deviation metals, except chromium, which belong to a group IVA, VA or VIA element of a period 4, 5 or 6 of the Periodic Table.

4 Claims, 9 Drawing Sheets

ROTARY ANODE TYPE X-RAY TUBE

BACKGROUND OF THE INVENTION

1. Field of the Invention

The present invention relates to a rotary anode type X-ray tube and, more particularly, to an improvement in a rotating mechanism for supporting a rotaryanode of the X-ray tube.

2. Description of the Related Art

As is known, in a rotary anode type X-ray tube, a disk-like anode target is supported by a rotary structure and a stationary shaft having a bearing portion therebetween, and an electron beam emitted from a cathode is radiated on the anode target while the anode target is rotated at a high speed by a rotating magnetic field generated by energizing the electromagnetic coil of a stator arranged outside a vacuum envelope, thus irradiating X-rays. The bearing portion is constituted by a rolling bearing, such as a ball bearing, or a dynamic pressure type sliding bearing which has bearing surfaces with spiral grooves and uses a metal lubricant consisting of, e.g., gallium (Ga) or a gallium-indiumtin (Ga-In-Sn) alloy. Rotary-anode type X-ray tubes using the latter bearing are disclosed in, e.g., Published Examined Japanese Patent Application No. 60-21463 and Published Unexamined Japanese Patent Application Nos. 60-97536, 60-117531, 61-2914, 62-287555 and 2-227948.

The rotary structure for supporting the anode target usually includes a rotating shaft fixed to the anode target and made of metal having a high melting point, a cylindrical core fixed to the rotating shaft and made of ferromagnetic matter such as iron to serve as a rotor for the induction motor, and an outer cylinder fitted onto and welded to the cylindrical core and made of metal such as copper having a high conductivity. The rotary structure is rotated at high speed on the principle of the induction motor while applying rotating magnetic field from a stator located outside the tube to the rotating structure.

In the rotary anode type X-ray tubes which are disclosed in the above-mentioned Official Gazettes, molybdenum, molybdenum alloy, tungsten or tungsten alloy is used as material for forming the slide bearing surfaces. When the bearing surfaces are made of one of these metals, however, there is fear that the bearing surfaces are likely to be oxidized at the processes of manufacturing the X-ray tube and that their wet capability relative to the liquid metal lubricant is degraded. Further, the bearing surface and the liquid metal lubricant may be reacted with each other and the metal lubricant may be permeated into the bearing surface at high temperature, when the X-ray tube is heated in a manufacturing process or during an operation of the X-ray tube. Thus, the bearing surfaces may be made rough and changed in dimension. The dimension of a clearance between the bearing surfaces is thus changed, so that stable bearing work cannot be kept.

SUMMARY OF THE INVENTION

The object of the present invention is therefore to provide a rotary anode type X-ray tube which can be manufactured at relatively low in cost, wherein bearing surfaces have a good wet capability relative to the liquid metal lubricant and the erosion of the bearing surface caused by the liquid metal lubricant can be reduced to keep the bearing work more stable.

According to the present invention, there can be provided a rotary anode type X-ray tube comprising: an anode target; a rotary structure having one end to which the anode target is fixed; a stationary structure for holding the rotary structure rotatable; a slide bearing section including bearing surfaces which are partly formed on the rotary and stationary structures and provided with spiral grooves formed thereon; and a metal lubricant applied to the bearing section and kept liquid when the X-ray tube is operated; wherein the bearing surface or surfaces of at least one of the rotary and stationary structures are made of ceramics whose main component is the carbide, boride or nitride of at least one of those transition metals, except chromium, which belong to a Group IVA, Va or VIA of a period 4, 5 or 6 of the Period Table.

According to the present invention, the bearing surfaces made of one of these ceramics have a good wet capability relative to the liquid metal lubricant and they hardly react with the liquid metal lubricant because their melting point sufficiently high, thereby preventing them from being eroded. In addition, the metal material which is relatively low in cost can be used as bearing base material. Further, these ceramics have a conductivity so high enough as to form an anode current passage in the X-ray tube, thereby enabling a slide bearing of the hydrodynamic type to be formed without making its structure complicated. A more stable bearing work can be thus kept for a longer time.

BRIEF DESCRIPTION OF THE DRAWINGS

FIG. 9 is an enlarged view of the interface between the rotary structure and stationary structure in FIG. 9*a;*

DETAILED DESCRIPTION OF THE PREFERRED EMBODIMENTS

Figure 1:
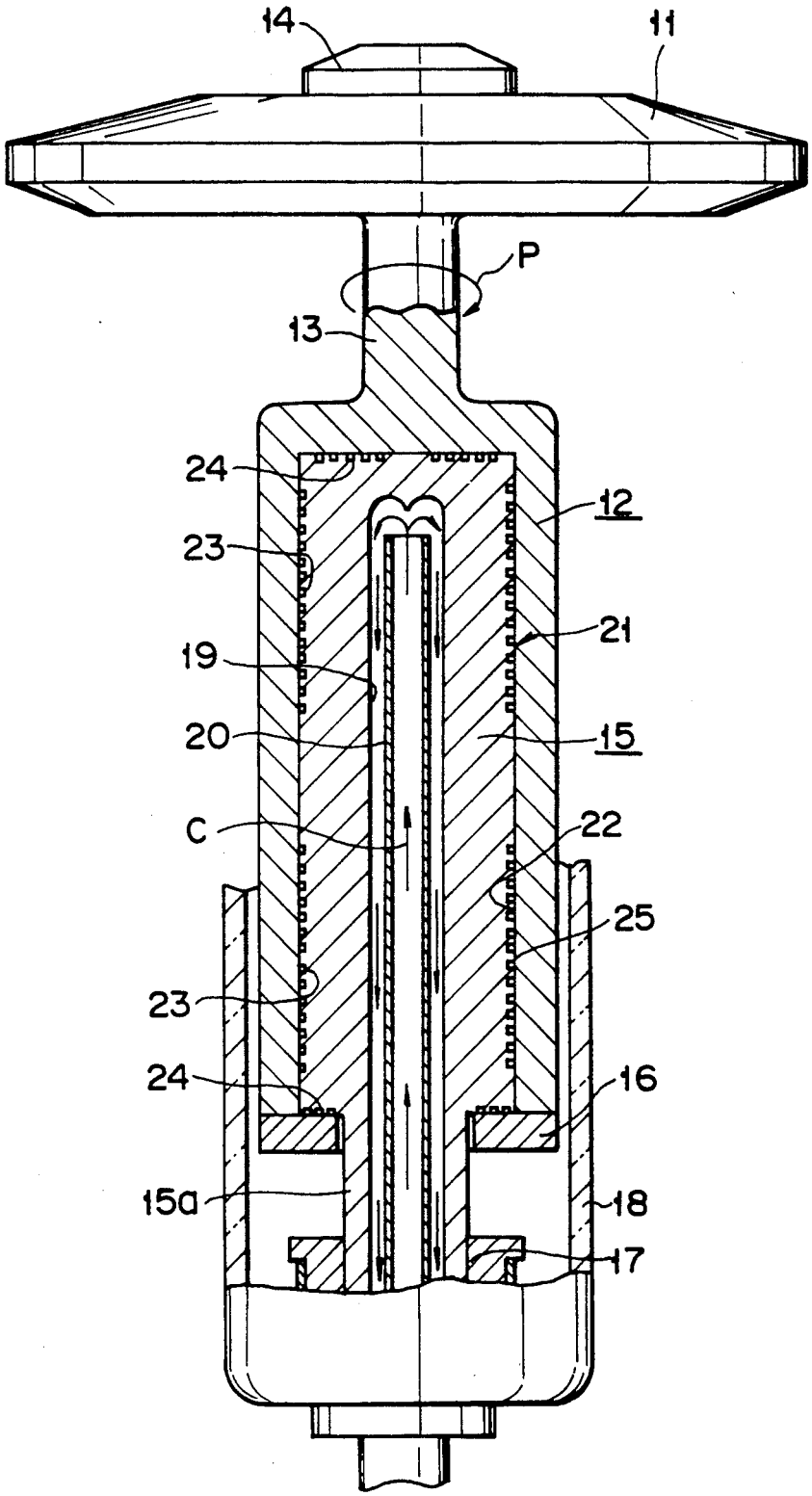
FIG. 1 is a vertical-sectional view showing a rotary anode type X-ray tube according to an embodiment of the present invention.
Figure 2:
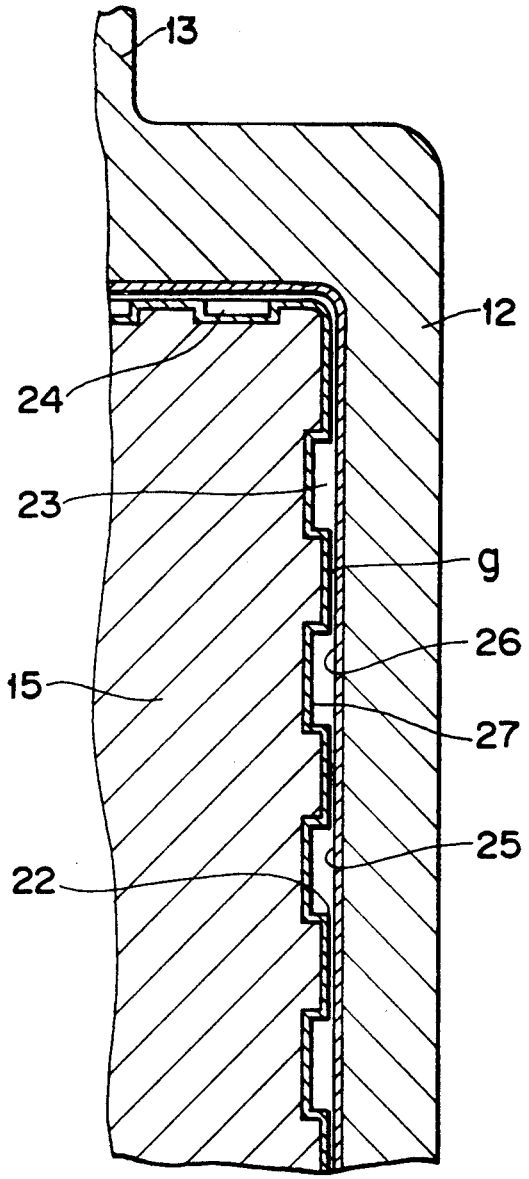
FIG. 2 is an enlarged vertical-sectional view showing the main portion of the rotary anode type X-ray tube.

Some embodiments of the present invention will be described below with reference to the accompanying drawings. Same component parts of these embodiments will be represented by same reference numerals.

EXAMPLE 1

Figure 3:
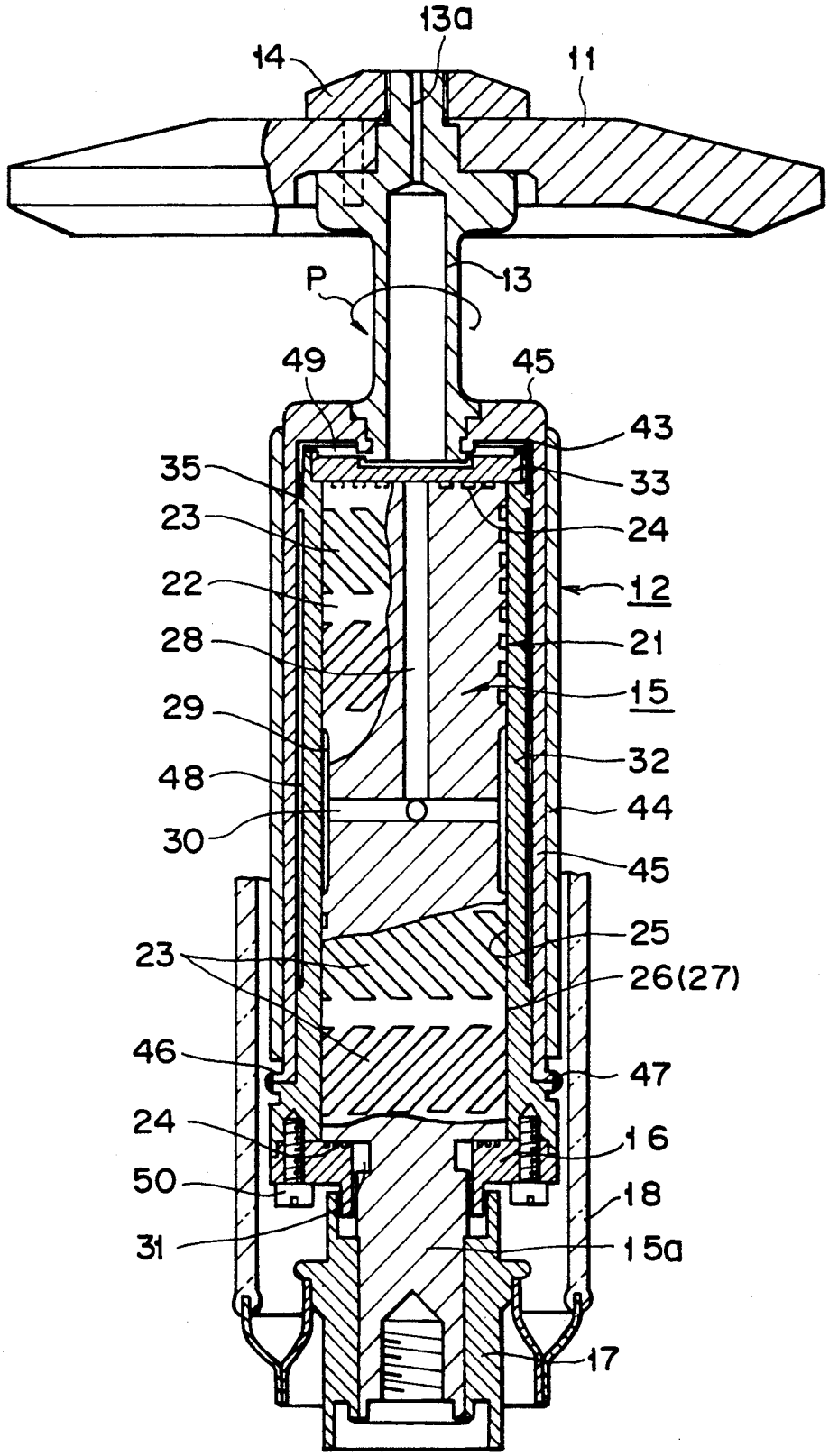
FIG. 3 is a vertical-sectional view showing the rotary anode type X-ray tube according to another embodiment of the present invention.
Figures 4A, 4B:
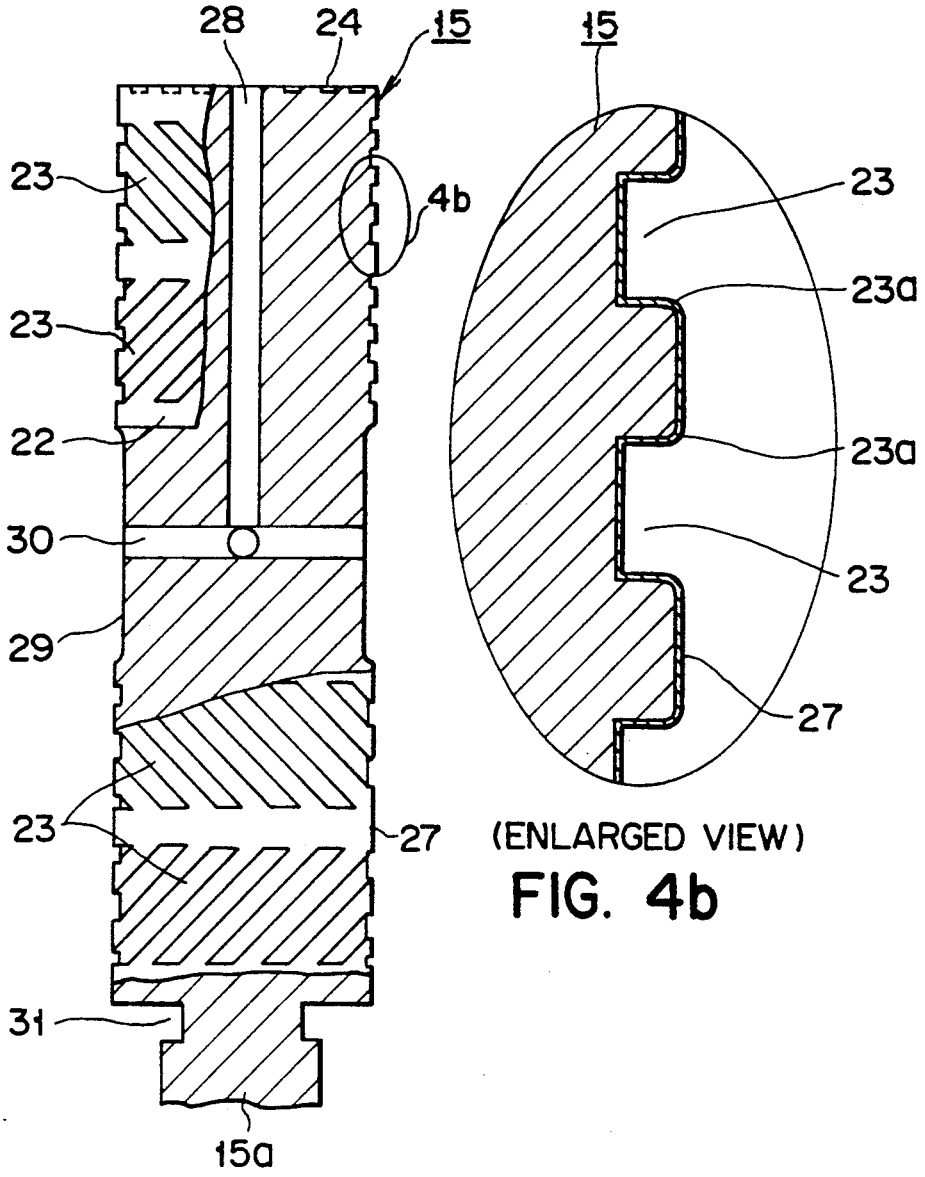
FIG. 4*a* is a vertical-sectional view showing a main portion of the rotary anode type X-ray tube in FIG. 3.
FIG. 4*b* is an enlarged view of a slide bearing surface of the stationary structure of FIG. 4*a*.
Figure 5:
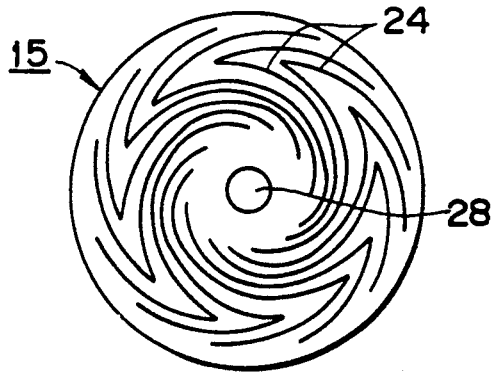
FIG. 5 is a top view showing the rotary anode type X-ray tube in FIG. 3.
Figure 6:
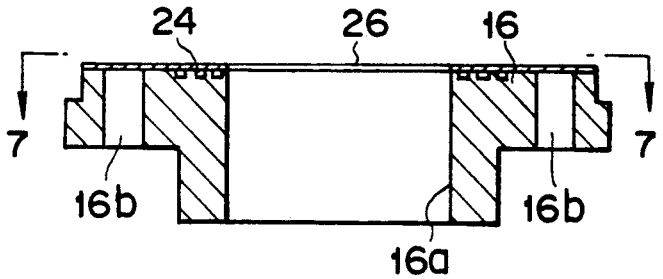
FIG. 6 is a vertical-sectional view showing another main portion of the rotary anode type X-ray tube in FIG. 3.
Figure 7:
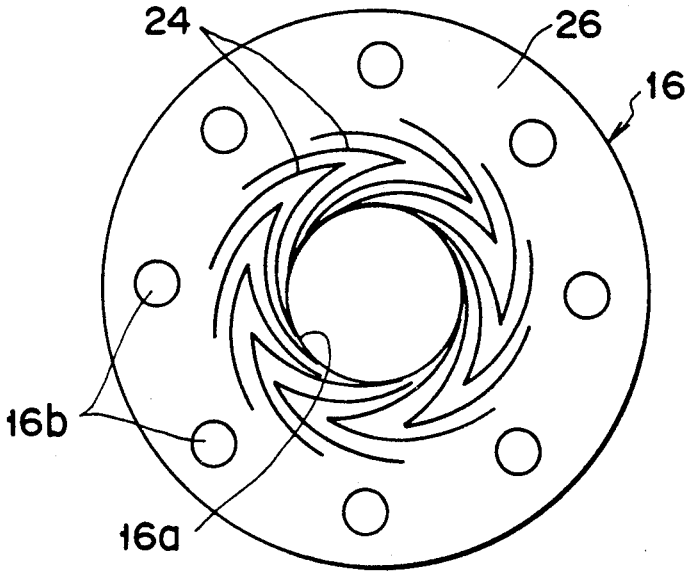
FIG. 7 is a top view taken along a line 7—7 in FIG. 6.
Figure 8:
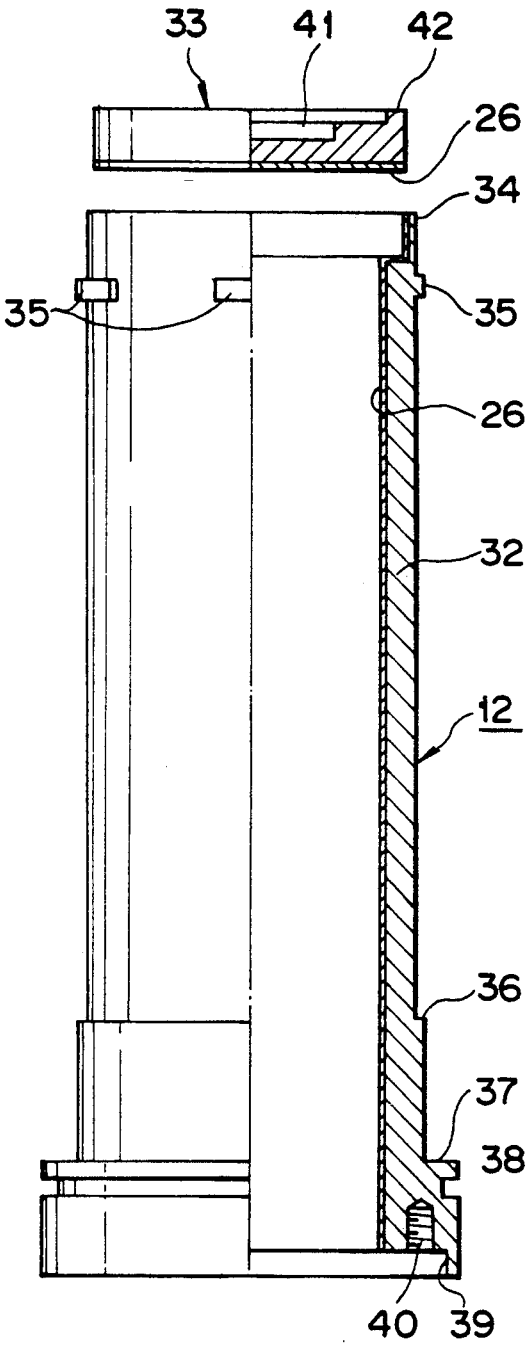
FIG. 8 is a vertical-sectional exploded partial views showing a further main portion of the rotary anode type X-ray tube in FIG. 3.

As shown in FIGS. 1 and 3, a disk-like anode target 11 made of heavy metal is fixed to a rotating shaft 13 by a nut 14 and the rotating shaft 13 is projected from one end of a rotary structure 12 which is shaped substantially like a cylinder having a bottom section. A stationary structure 15 which is shaped substantially like a column is fitted into the rotary structure 12. The stationary structure 15 has a smaller-diameter portion 15*a* at the bottom end thereof. A thrust bearing disk 16 is fixed to the bottom open end of the rotary structure 12 along the border line of the stationary structure 15 with its smaller-diameter portion 15*a*. The bottom end of the smaller-diameter portion 15*a* of the stationary structure 15 is connected to an anode support ring 17, which is vacuum-tightly connected to a vacuum envelope 18 made of glass. The stationary structure 15 is made hollow to form a coolant passage 19 therein and a pipe 20 is inserted into the coolant passage 19 in the stationary structure 15, thereby allowing a coolant to be circulated, as shown by arrows C, in the coolant passage 19. Inner and outer surfaces of the rotary and stationary structures 12 and 15 which face to each other form a slide bearing section 21 of the hydrodynamic pressure type, as disclosed in the above-mentioned Patent Publication and Disclosures. For this purpose, two sets of spiral grooves 23 each having a herring-bone pattern for radial bearing are formed on the outer slide bearing surface 22 of the stationary structure 15. Further, spiral grooves 24 each having a circle-like herringbone pattern for thrust bearing are formed on both ends slide bearing surfaces of the stationary structure 15. These spiral grooves 23 and 24 have a depth of about 20 micrometers. The inner slide bearing surface 25 of the rotary structure 12 is made flat and smooth but spiral grooves may be formed on it if necessary. The both bearing surfaces 22 and 25 of the rotary and stationary structures 12 and 15 are faced adjacent to each other with a bearing clearance (g) of about 20 micro-meters interposed therebetween. A metal lubricant (not shown) which is liquid under the rotating action is filled in the bearing clearance (g) between them and also in the spiral grooves on their bearing surfaces.

The bearing surfaces 22 and 25 of the rotary and stationary structures 12 and 15 are formed by bonding thin ceramic films 26 and 27 to surfaces of bearing base material such as metal. The bearing base material of each of the rotary and stationary structures 12 and 15 is an iron alloy such as stainless steel, or such as carbon tool steel SK4 or SKD11 defined by Japanese Industrial Standards (JIS) and containing a small amount of carbon (0.5–2.5 weight %). The thin ceramic film 26 or 27 made of the carbide (VC) of vaandium, a transition metal, which is a Group VA element in Period 4 of the Periodic Table, is bonded to that inner or outer surface of each bearing base material which serves as the bearing surface. In order to form these thin ceramic films 26 and 27, those portions of each of the bearing base materials which do not serve as the bearing surface are properly masked and the bearing base materials thus masked are immersed for several hours in that molten salt bath agent in the electric furnace which is kept at a temperature of 500°–1250° C. and which contained vaandium. Thin film of vaandium carbide (VC), about 10 micrometers thick, is thus bonded to the bearing surface of each of the bearing base materials, which is then heat-treated.

The melting point of ceramic made of vaandium carbide (VC) is about 2850° C. The coefficient of its thermal expansion at a temperature of 20°–200° C. is 7.2–6.5 $\times 10^{-6}$/° C., which is not remarkably different from that of the bearing base material, so that the possibility of causing cracks can be reduced to a minimum. Particularly the thin ceramic film of this vaandium carbide is formed in such a way that a part of carbon in the base material such as steel is diffused and combined with vaandium carbide. Therefore, the strength at which the thin ceramic film is bonded to the bearing base material is quite high. In addition, the thin ceramic film is strong relative to high temperature and good in abrasion resistance. Further, it is also good in wet capability relative to the liquid metal lubricant such as Ga and Ga alloy and it hardly reacts to the lubricant because its melting point is high enough. It is therefore hardly eroded by the lubricant. It is conductive and can therefore cooperate with the liquid metal lubricant to form a part of the anode current passage. The spiral grooves 23 and 24 are previously formed on the outer surfaces of the stationary structure 15 and this thin ceramic film adheres to them at a substantially same thickness. As described above, the thin ceramic film serves to make the inner and outer surfaces of the bearing base materials suitable for use as the hydrodynamic pressure type slide bearing in which the liquid metal lubricant is used. The above-mentioned carbon stainless steel and others which are the bearing base materials are relatively low in cost and they can be far more easily processed, as compared with Mo and W. Further, their bearing surfaces have a high strength against high temperature and are hardly eroded by the lubricant at high temperature. The operating temperature of their bearing surfaces can be therefore increased to about 500° C., for example. The operating temperature of the anode target can be thus made high. In other words, the cooling rate of the anode target can be made high. Therefore, the average value of current applied to the anode target can be made relatively large. A rotary anode type X-ray tube having a more stable bearing capacity and a higher cooling rate can be more easily provided.

EXAMPLE 2

Thin ceramic film made of vanadic boride ($VB_2$) is formed on inner and outer surfaces of the bearing base materials such as metal. The thin ceramic film of this vanadic boride ($VB_2$) has a melting point of about 2400° C. and a thermal expansion coefficient of about 7.6 $\times 10^{-6}$/° C. at temperature range of 20°–200° C. This thin ceramic film is similarly suitable for making the inner and outer faces of the bearing base materials serve as the hydrodynamic pressure type slide bearing surfaces for the X-ray tube in which the liquid metal lubricant is used.

EXAMPLE 3

The ceramic film made of vanadic nitride (VN) is formed on the inner and outer surfaces of the bearing base materials. This thin ceramic film has a melting point of about 2050° C. and a thermal expansion coefficient of about $8.1 \times 10^{-6}/°$ C. at the temperature range of 20°–200° C. The melting point of this thin ceramic film is a little lower. When temperature is kept a little lower at both of the manufacturing process and the operation of the X-ray tube, therefore, the inner and outer surfaces of the bearing base materials on which the thin ceramic film of vanadic nitride (VN) has been formed can be used as the hydrodynamic pressure type slide bearing surfaces for the X-ray tube in which the liquid metal lubricant is used.

EXAMPLE 4

Spiral grooves 23 and 24 are formed on the outer circumference of the stationary structure 15 which serves as the radial slide bearing surface 22 and also on the front end surface thereof which serves as the thrust bearing surface, as shown in FIGS. 3 through 8. A hole 28 extending in the axial direction of the stationary structure 15 to store and circulate the liquid metal lubricant therein is formed in the stationary structure 15 along the center axis thereof. Radial holes 30 extending from the center of the stationary structure 15 in four radial directions thereof and opened at the outer circumference of a smaller-diameter portion 29 thereof are also formed in the stationary structure 15. Further, a circumferential groove 31 is formed along the border of the smallest-diameter portion 15*a* relative to the lower large-diameter portion of the stationary structure 15. Those outer surfaces of the stationary structure 15 which do not serve as the bearing are properly masked and the thin ceramic film 27 made of the titanium nitride (TiN), a transition metal, which is a Group IVA element in Period 4 of the Periodic Table is formed on the fixed body 15 at a thickness of 0.5 –10 micro-meters or a thickness of 5 micro-meters, for example, according to the chemical vapor deposit (CVD). As shown on enlarged scale in FIG. 4, top rims 23*a* of the spiral groove formed on the outer surfaces of the base material of which the stationary structure is made are previously rounded or tapered not to make projections on rims 23*a* of the thin ceramic film.

On the other hand, a bearing cylinder 32 whose inner circumference serves as the radial bearing surface, a disk 33 connected to the opening portion of the bearing cylinder 32 and the bearing ring 16 connected to the bottom opening portion of the bearing cylinder 32 are previously prepared as different component parts to form the rotary structure 12. The bearing base material of which these component parts are made is metal. A stepped portion for receiving the disk 33 and a welding bead 34 are formed at the opening portion of the bearing cylinder 32. Plural clearance-holding projections 35 are formed on the outer circumference of the bearing cylinder 32. A clearance-holding stepped portion 36, another stepped portion 37 on which a rotor cylinder is seated, and a welding bead 38 are formed on that outer circumference of the bearing cylinder 32 which is adjacent to the bottom opening portion thereof. A stepped portion 39 for receiving the bearing ring 16 and plural female screw holes 40 are formed on the bottom open end face of the bearing cylinder 32. The thin ceramic film 26 made of titanium nitride (TiN) is formed on the inner circumference of the bearing cylinder 32 at a thickness of about 5 μm according to the CVD. The bearing cylinder 32 is so simple in shape that CVD reaction gas could prevail all over the inner circumference of the bearing cylinder 32. This enables the film to be made high in quality and formed on all area of the inner circumference of the bearing cylinder 32 at a uniform thickness. On the other hand, a recess 41 and a welding bead 42 are formed on the top of the bearing disk 33. The thin ceramic film 26 made of titanium nitride (TiN) and having a thickness of about 10 μm is previously formed on that inner circumference of the bearing disk 33 which serves as the thrust bearing surface, while holding the bearing disk 33 as a single component. The spiral groove 24 is previously formed on that inner bottom surface of the bearing ring 16 which encloses a center hole 16*a* thereof and which serves as the thrust bearing surface. The thin ceramic film 26 made of titanium nitride (TiN) and having a thickness of about 5 μm is formed on this inner bottom surface of the bearing ring 16, while holding the bearing ring 16 as a single component. Plural screw through-holes 16*b* are formed at the flange of the bearing ring 16. The thin ceramic film is formed on flat surfaces of these bearing disk 33 and ring 16. This enables the film to be easily formed according to the CVD, having a uniform thickness and a homogeneous quality. The spiral groove having a circle-like herringbone pattern for thrust bearing may be formed on the underside of the bearing disk 33.

These component parts on which the thin ceramic film has been formed as described above are combined with one another as follows. The bearing disk 33 is fitted into the stepped portion of the bearing cylinder 32 and combined with each other by arc-welding their welding beads 34 and 42. This welded portion between them is represented by a numeral 43. This welding is carried out at a position remote from their bearing surfaces while heating them locally. Therefore, there is no fear that the thin ceramic film on their bearing surfaces is changed in quality. An assembly of the bearing cylinder 32 and disk 33 is inserted into a rotor cylinder 45, made of ferromagnetic material, to which the rotating shaft 13 is fixed and onto which a copper cylinder 44 is fixedly fitted is then fitted onto until its bottom end is seated on the stepped portion 37 of the bearing cylinder 32. Welding beads 46 and 38 at the bottom end of the rotor cylinder 32 are welded, as shown by a numeral 47, by arc welding to combine these cylinders 45 and 32 with each other. A heat-insulating clearance 48 is formed at this time between these cylinders 45 and 32 by their clearance-holding projections 35 and stepped portion 36. The heat transmitting path extending form the anode target to the slide bearing can be thus made long by the hat insulating clearance 48, so that transmission of target heat to the slide bearing can be reduced. It is desirable that the heat insulating clearance 48 has a dimension of 0.1–1 mm in the radial direction of the cylinders. The top welded portion 43 is located in a top clearance 49 which serves to receive the rotating shaft 13 and thus kept not contacted with the inner face of a shoulder 45*a* of the rotor cylinder 45. The rotating shaft 13 is provided with a ventilation hole 13*a* to exhaust a space which includes the clearances 48 and 49 high in vacuum at the exhaust process.

The rotary structure 12 assembled as described above was located in the vacuum heating furnace while positioning the rotating shaft 13 down, gas present between the component parts of the rotating body 12 is exhausted, and a predetermined amount of the liquid metal lubricant (not shown) such as Ga-In-Sn alloy is filled in the hollow portion of the bearing cylinder 32. The stationary structure 15 is then slowly inserted into the bearing cylinder 32 and the bearing ring 16 is fixed to the bottom end face of the bearing cylinder 32 by screws 50. The bearing clearance of about 20 μm is formed between the bearing surfaces of the rotary and stationary structures thus assembled. The liquid metal lubricant is therefore allowed to fill the bearing clearance, the spiral grooves and the holes in the stationary structure. The anode support ring 17 is then vacuum-tightly welded to the smallest-diameter portion 15*a* of the stationary structure 15 and its thin sealing ring is further vacuum-tightly welded to a sealing ring of the vacuum envelope 18. The vacuum envelope 18 is exhausted and the X-ray tube is thus created.

The thin ceramic film made of titanium nitride (TiN) and formed on the bearing surfaces of the rotary and stationary structures has a melting point of about 3080° C. and a thermal expansion coefficient of $9.8 \times 9.2^{-6}/°$ C., which is relatively large. When iron, iron alloy such as stainless steel having a thermal expansion coefficient of $9.0\text{–}14.0 \times 10^{-6}/°$ C. is used, therefore, neither cracks nor peeling-off of the film is caused. The thin ceramic film is high in its bonding strength relative to the base materials and also good in its strength relative to high temperature and in its abrasion resistance. Further, it is good in its becoming-wet capacity relative to the liquid metal lubricant and it is hardly eroded by this lubricant. A more stable operation of the hydrodynamic pressure slide bearing can be thus guaranteed for a long time.

EXAMPLE 5

Thin ceramic film made of titanium carbide (TiC) is formed on surfaces of the bearing base materials such as metal. This thin ceramic film of titanium carbide (TiC) has a melting point of about 3150° C. and a thermal expansion coefficient of about $8.3\text{–}7.6 \times 10^{6}/°$ C. at the temperature range of 20°–200° C. This thin film is suitable for use on the bearing surfaces of the bearing base materials to form hydrodynamic pressure slide bearing surfaces for the X-ray tube in which the liquid metal lubricant is used.

EXAMPLE 6

Thin ceramic film made of titanium boride ($TiB_2$) is formed on surfaces of the bearing base materials such as metal. This thin ceramic film of titanium boride ($TiB_2$) has a melting point of about 2920° C. and a thermal expansion coefficient of about $4.6\text{–}4.8 \times 10^{-6}/°$ C. at the temperature range of 20°–200° C. This thin film is suitable for the hydrodynamic pressure slide bearing surfaces of the X-ray tube in which the liquid metal lubricant is used.

EXAMPLE 7

Thin ceramic film made of the carbide ($MO_2C$) of molybdenum (Mo), a transition metal, which is a Group VIA element of Period 5 of the Periodic Table is formed on surfaces of the bearing base materials such as metal. This thin ceramic film has a melting point of about 2580° C. and a thermal expansion coefficient of about $7.8 \times 10^{-6}/°$ C. at the temperature range of 20°–200° C. This thin film is suitable for the hydrodynamic pressure slide bearing surfaces of the X-ray tube in which the liquid metal lubricant is used.

EXAMPLE 8

Thin ceramic film made of the molybdenum boride ($MoB_2$ or MoB) of molybdenum, a transition metal, which is a Group VIA element in Period 4 of the Periodic Table is formed on surfaces of the bearing base materials such as metal. This thin ceramic film has a melting point of about 2200° or 2550° C. and a thermal expansion coefficient of about $8.6 \times 10^{-6}/°$ C. at the temperature range of 20°–200° C. This thin film is similarly suitable for the dynamic pressure slide bearing surfaces of the X-ray tube in which the liquid metal lubricant is used.

EXAMPLE 9

Thin ceramic film made of the carbide ($Nb_2C$ or NbC) of niobium (nb), a transition metal, which is a Group VA element of a Period 5 of the Periodic Table is formed on surfaces of the bearing base materials such as metal. This thin ceramic film of niobium carbide has a melting point of about 3080° or 3600° C. and a thermal expansion coefficient of about $7.0\text{–}6.5 \times 10^{-6}/°$ C. at the temperature range of 20°–200° C. This thin film is similarly suitable for the hydrodynamic pressure slide bearing surfaces of the X-ray tube in which the liquid metal lubricant is used.

EXAMPLE 10

Thin ceramic film made of niobium boride ($NbB_2$) is formed on surfaces of the bearing base materials such as metal. This thin ceramic film has a melting point of about 3000° C. and a thermal expansion coefficient of about $8.0 \times 10^{-6}/°$ C. at the temperature range of 20°–200° C. This thin film is also suitable for the hydrodynamic pressure slide bearing faces of the X-ray tube in which the liquid metal lubricant is used.

EXAMPLE 11

Thin ceramic film made of niobium nitride (NbN) is formed on surfaces of the bearing base materials such as metal. This thin ceramic film has a melting point of about 2100° C. and a thermal expansion coefficient of about $10.1 \times 10^{-6}/°$ C. The melting point of this thin film is a little lower When temperature at which the X-ray tube is manufactured and operated is made a little lower, therefore, this thin film can also be used for the dynamic pressure slide faces of the X-ray tube in which the liquid metal lubricant is used.

EXAMPLE 12

Thin ceramic film made of the carbide (ZrC) of zirconium (Zr), a transition metal, which is a Group IVA element of a period 5 of the Periodic Table is formed on surfaces of the bearing base materials such as metal This thin ceramic film of zirconium carbide has a melting point of about 3420° C. and a thermal expansion coefficient of about $6.9 \times 10^{-6}/1°$ C. at the temperature range of 20°–200° C. This thin film is similarly suitable for the hydrodynamic pressure slide bearing surfaces of the X-ray tube in which the liquid metal lubricant is used.

EXAMPLE 13

Thin ceramic film made of zirconium boride ($ZrB_2$) is formed on surfaces of the bearing base materials such as metal. This thin ceramic film has a melting point of about 3040° C. and a thermal expansion coefficient of about $5.9 \times 10^{-6}/°$ C. at the temperature range of 20°–200° C. This thin film is also suitable for the dynamic pressure slide bearing surfaces of the X-ray tube in which the liquid metal lubricant is used.

EXAMPLE 14

Thin ceramic film made of zirconium nitride (ZrN) is formed on surfaces of the bearing base materials such as metal. This thin ceramic film has a melting point of about 2980° C. and a thermal expansion coefficient of about $7.9 \times 10^{-6}/°$ C. at the temperature range of 20°-200° C. This thin film can be similarly used for the hydrodynamic pressure slide bearing surfaces of the X-ray tube in which the liquid metal lubricant is used.

EXAMPLE 15

Thin ceramic film made of the carbide ($W_2C$ or WC) of tungsten (W), a transition metal, which is a Group VIA element of a period 6 of the Periodic Table is formed on surfaces of the bearing base materials such as metal. This thin ceramic film of tungsten carbide has a melting point of about 2795° or 2785° C. and a thermal expansion coefficient of about $6.2\text{-}5.2 \times 10^{-6}/°$ C. at the temperature range of 20°-200° C. This thin film is also suitable for the hydrodynamic pressure slide bearing surfaces of the X-ray tube in which the liquid metal lubricant is used.

EXAMPLE 16

Thin ceramic film made of tungsten boride ($WB_2$ or WB) is formed on surfaces of the bearing base materials such as metal. This thin ceramic film has a melting point of about 2370° or 2800° C. and a thermal expansion coefficient of about $7.8\text{-}6.7 \times 10^{-6}/°$ C. at the temperature range of 20°-200° C. This thin film is similarly suitable for the hydrodynamic pressure slide bearing surfaces of the X-ray tube in which the liquid metal lubricant is used.

EXAMPLE 17

Thin ceramic film made of carbide ($Ta_2C$ or TaC) of tantalum (Ta), a transition metal, which is a Group VA element of a period 6 of the Periodic Table is formed on surfaces of the bearing base materials such as metal. This thin ceramic film of tantalum carbide has a melting point of about 3400° or 3880° C. and a thermal expansion coefficient of about $8.3\text{-}6.6 \times 10^{-6}/°$ C. at the temperature range of 20°-200° C. This thin film is also suitable for the hydrodynamic pressure slide bearing surfaces of the X-ray tube in which the liquid metal lubricant is used.

EXAMPLE 18

Thin ceramic film made of tantalum boride ($TaB_2$) ia formed on surfaces of the bearing base materials such as metal. This thin ceramic film has a melting point of about 3100° C. and a thermal expansion coefficient of about $8.2\text{-}7.1 \times 10^{-6}/°$ C. at the temperature range of 20°-200° C. This thin film is similarly suitable for the dynamic pressure slide bearing surfaces of the X-ray tube in which the liquid metal lubricant is used.

EXAMPLE 19

Thin ceramic film made of tantalum nitride (TaN) is formed on surfaces of the bearing base materials such as metal. This thin ceramic film has a melting point of about 3090° C. and a thermal expansion coefficient of about $5.0 \times 10^{-6}/°$ C. at the temperature range of 20°-200° C. This thin film can also be used for the hydrodynamic pressure slide bearing surfaces of the X-ray tube in which the liquid metal lubricant is used.

EXAMPLE 20

Thin ceramic film made of carbide (HfC) of hafnium (Hf), a transition metal, which is a Group IVA element of a period 6 of the Periodic Table is formed on surfaces of the bearing base materials such as metal. This thin ceramic film of hafnium carbide has a melting point of about 3700° C. and a thermal expansion coefficient of about $7.6\text{-}6.7 \times 10^{-6}/°$ C. at the temperature range of 20°-200° C. This thin film is similarly suitable for the hydrodynamic pressure side bearing surfaces of the X-ray tube in which the liquid metal lubricant is used.

EXAMPLE 21

Thin ceramic film made of hafnium boride ($HfB_2$) is formed on surfaces of the bearing base materials such as metal. This thin ceramic film has a melting point of about 3250° C. and a thermal expansion coefficient of about $6.3 \times 10^{-6}/°$ C. at the temperature range of 20°-200° C. This thin film is also suitable for the hydrodynamic pressure slide bearing surfaces of the X-ray tube in which the liquid metal lubricant is used.

EXAMPLE 22

Thin ceramic film made of hafnium nitride (HfN) is formed on surfaces of the bearing base materials such as metal. This thin ceramic film has a melting point of about 3310° C. and a thermal expansion coefficient of about $7.4\text{-}6.9 \times 10^{-6}/°$ C. at the temperature range of 20°-200° C. This thin film can be similarly used for the hydrodynamic pressure slide bearing surfaces of the X-ray tube in which the liquid metal lubricant is used.

Figures 9A, 9B:
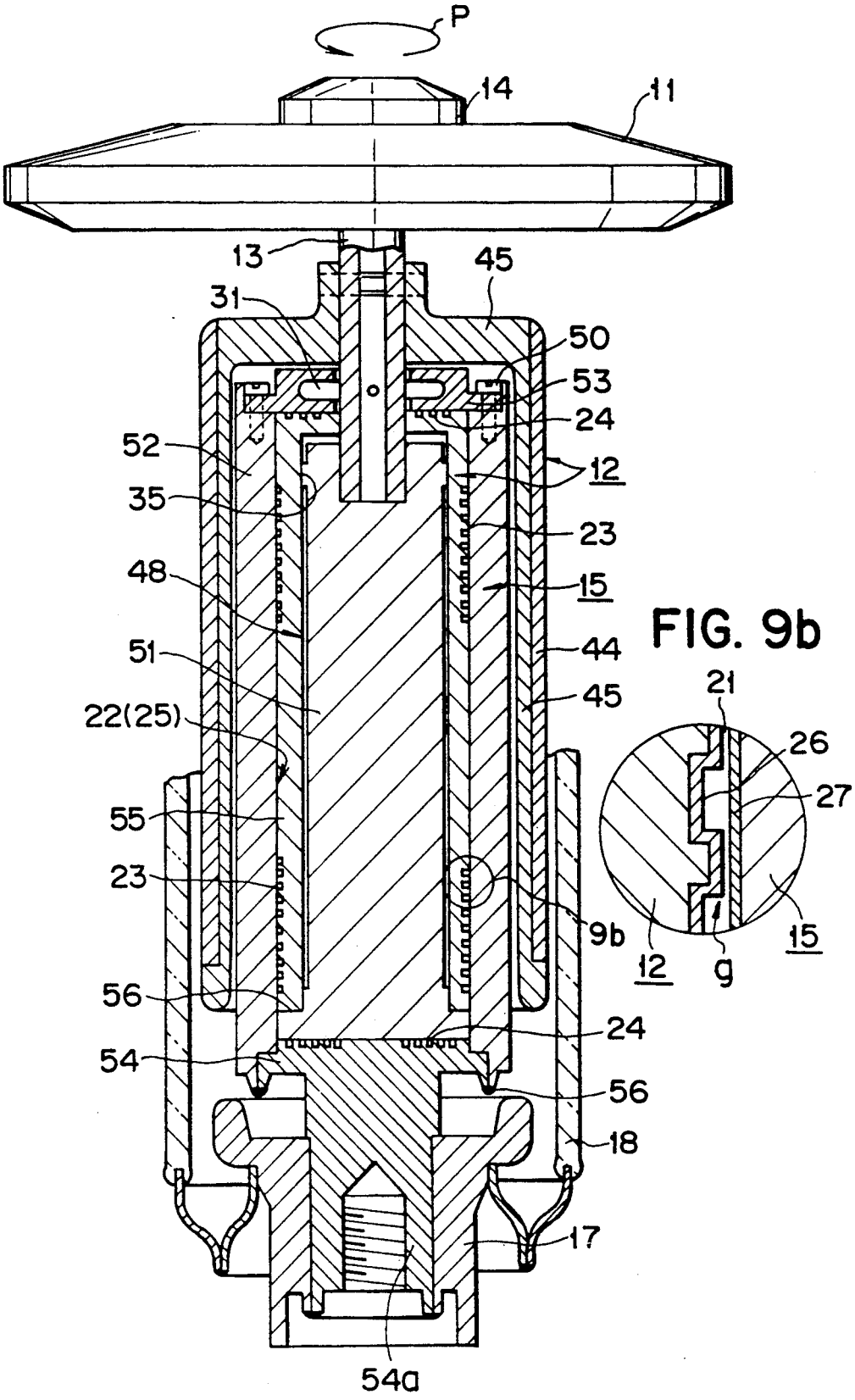
FIG. 9 is a vertical-sectional view showing the rotary anode type X-ray tube according to a further embodiment of the present invention.

In the case of the X-ray tube according to a further embodiment of the present invention shown in FIG. 9, a rotary column 51 rotated together with the anode target 11 is located in the center of the tube. This X-ray tube will be described according to a preferable order of tube assembling processes. Thin ceramic film is previously formed on the inner circumference of a fixed cylinder 52 which is made open at both ends thereof, and on bearing surfaces of top and bottom fixed disks 53 and 54. The material of which these component parts are made is same as that in the case of the above-described embodiments. The spiral groove 24 for thrust bearing is previously formed on the top of the bottom fixed disk 54. Thin ceramic film is also previously formed on bearing faces of an inner rotating bearing cylinder 55 of the rotary structure 12 and on the bottom bearing face of the rotary column 51. Spiral grooves 23 and 24 are formed on the outer circumference and the top of the rotating bearing cylinder 55. The rotating bearing cylinder 55 is fitted onto the rotary column 51 to which the rotating shaft 13 is fixedly soldered, and soldered to the column 51 at the bottom end 56 thereof. On the other hand, the stationary cylinder 52 and the fixed bottom disk 54 are soldered to each other at their soldered portion 56. Gas in an assembly of these stationary cylinder 52 and bottom disk 54 is exhausted in the vacuum heating furnace and Ga alloy lubricant is instead filled in it. Another assembly of the rotary column 51 and cylinder 55 is inserted into it and the stationary disk 53 is fixed to the top of the stationary cylinder 52 by screws 50. Further, the rotor cylinder 45 having the copper cylinder 44 round it is fitted onto the fixed cylinder 52 and the rotating shaft 13 is fixed to the top of the cylinder 45 by screws. The target 11 is fixed to the rotating shaft 13. The X-ray tube is then completed according to the same assembling processes as those in the above-described cases.

One of the above-described thin ceramic films may be formed on faces of the bearing base metal materials at a predetermined thickness according to the PVD (or physical vapor deposit) and then heat-processed to such an extent as needed. It may be formed according to the molten salt bath immersion. Or it may be formed in the atmosphere of nitrogen gas according to the thermal nitriding manner.

Figure 10:
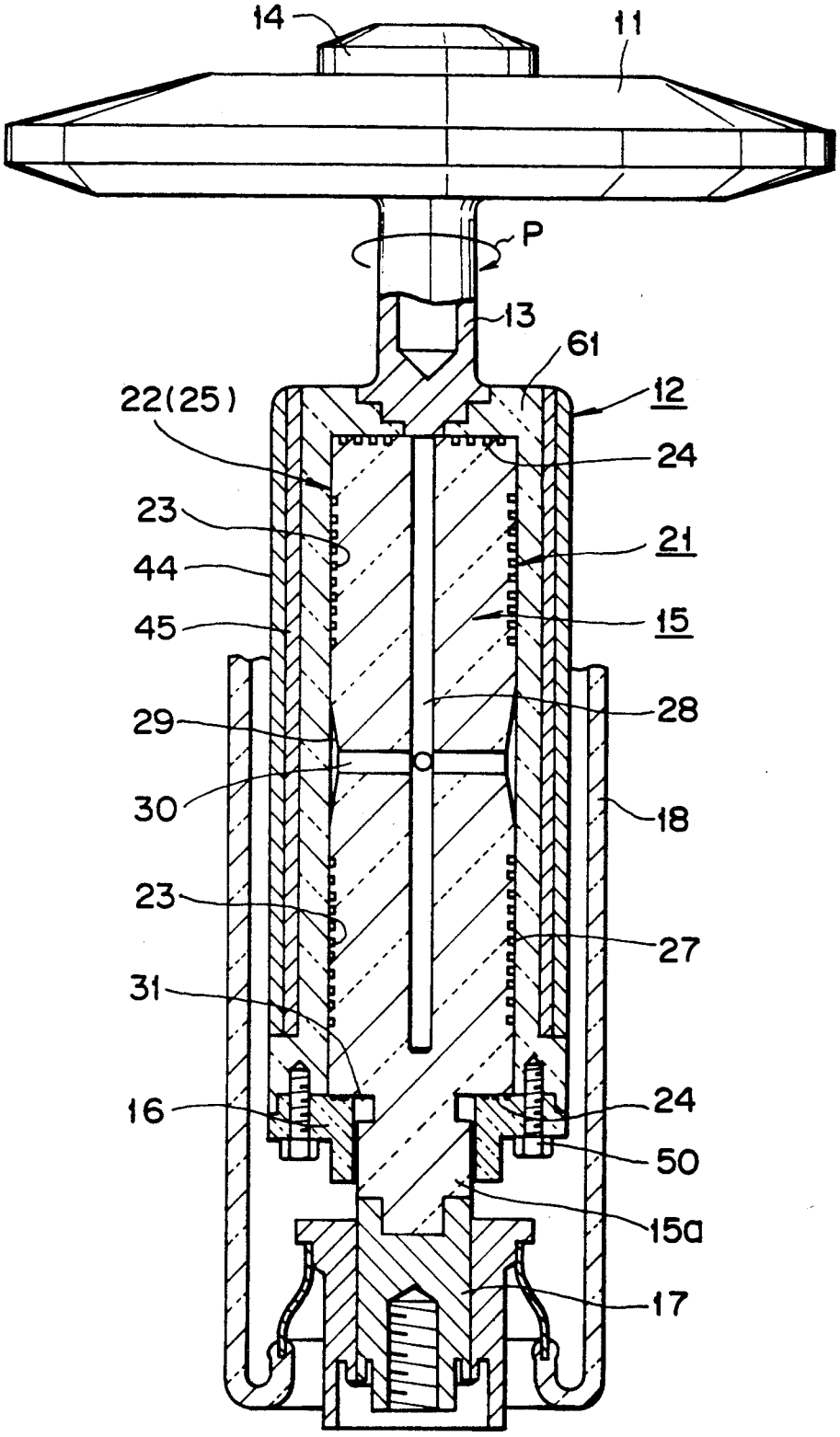
FIG. 10 is a vertical-sectional view showing the rotary anode type X-ray tube according to a still further embodiment of the present invention.

In the case of the X-ray tube according to a still further embodiment of the present invention shown in FIG. 10, a bearing cylinder 61 of the rotary structure 12 and the column-like stationary structure 15 are made of ceramics which is similar to the thin ceramic films in the above-described embodiments and whose main component is the nitride, boride or carbide of a transition metal, except chromium, belonging to the Group IVA, VA or VIA element of the period 4, 5 or 6 of the Periodic Table. Bearing surfaces of the rotary and stationary structures 12 and 15 are therefore made of this ceramics itself. The small-diameter portion 15*a* of the stationary structure 15 made of the ceramics and the iron-made anode support 17 are silver-soldered to mechanically and electrically connect them to each other. The anode current passage is thus provided.

Figure 11:
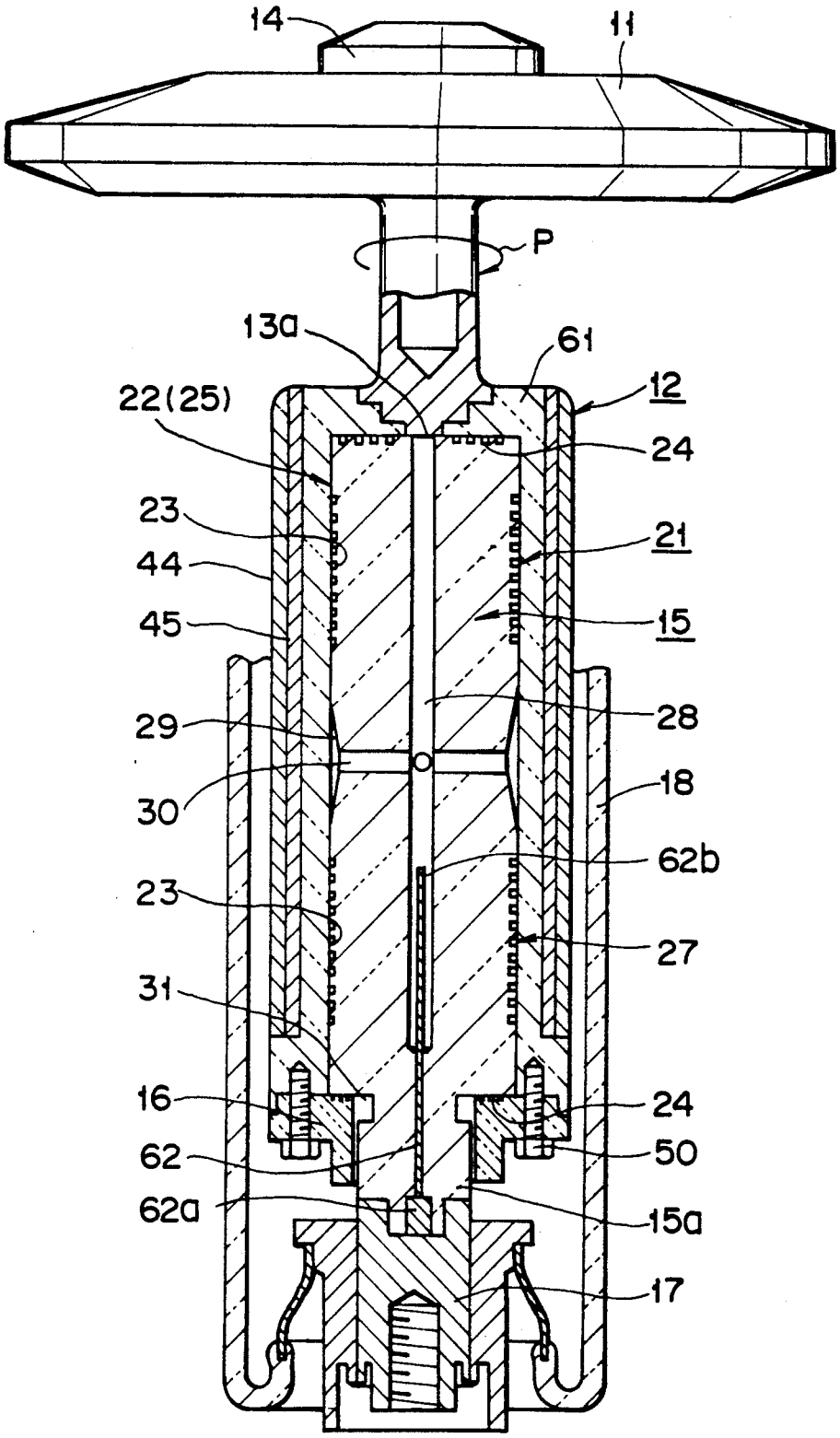
FIG. 11 is a vertical-sectional view showing the rotary anode type X-ray tube according to a still further embodiment of the present invention.

In a rotary anode type X-ray tube shown in FIG. 11, the stationary structure 15 itself is made of insulation ceramics such as silicon nitride ($Si_3N_4$) and one of the above-mentioned thin ceramic films is formed on its bearing surfaces. The rotary structure 12 may also be made of the insulation ceramics of silicon nitride or the above-mentioned conductive ceramics. In order to form the anode current passage, the bottom surface 13*a* of the molybdenum-made rotating shaft 13 connected to the anode target 11 is exposed at the same level as the thrust bearing end face of the stationary structure 15 and electrically connected to the liquid metal lubricant filled in the thrust bearing end face and the center hole 28 of the 15. A conductive rod 62 is passed through the bottom end face of the 15 in such a way that its one end 62*a* is electrically connected to the ironmade anode support 17 by silver soldering and that its other end 62*b* is extended into the center hole 28 of the 15 to electrically contact the liquid metal lubricant in the hole 28. The current circuit extending from the anode target 11 to the anode support 17 is thus formed.

It may be arranged that the bearing surface or surfaces of one of the cylinder and column bodies are made of molybdenum or tungsten and used with no thin ceramic film formed thereon and that those of the other have the thin ceramic film formed therein. The bearing base material on which the thin ceramic film is formed to form the bearing surface or surfaces may be molybdenum of tungsten.

The reason why chromium is excluded from those transition metals which belong to the Group IVA, VA or VIA of a period 4, 5 or 6 element of the Periodic Table and which are used to form the ceramics for bearing surfaces resides in that the carbide, boride or nitride of chromium has a quite low melting point and that it remarkably and impracticably reacts to the liquid metal lubricant such as Ga and Ga alloy.

When the X-ray tube is manufactured and used at a relatively high temperature, it is preferable to use ceramics made of the carbide of vaandium or molybdenum. It is more preferable to use ceramics made of the carbide or boride of columbium or tungsten because they are resistible to higher temperature. It is by far more preferable that ceramics made of the carbide ,boride or nitride of titanium, zirconium, hafnium or tantalum is used because they are resistible to by far higher temperature. Their melting points are higher than 2610° C. and they are good in abrasion resistance relative to the liquid metal lubricant.

Further, ceramics made by using, as it its main component, one of carbide, boride and nitride of the above-mentioned each transition metal and mixing in it at least one of carbide, boride and nitride of the other transition metal may be used. Ceramics made of titanium carbide and nitride |Ti (C, N)| can be mentioned as an example.

Still further, at least one other intermediate layer may be formed between the bearing base material and the ceramics layer. The intermediate layer may be so composed in this case as to have a thermal expansion coefficient which is between those of the bearing base material and the ceramics layer or as to increase its bonding strength relative to the bearing base material and the ceramics layer.

The liquid metal lubricant is not limited to those made of Ga, Ga-In alloy and Ga-In-Sn alloy whose main component is Ga. For example, Bi-In-Sn alloy containing a relatively large amount of bithmus (Bi), In-Bi alloy containing a relatively large amount of indium (In), or In-Bi-Sn alloy can be used as the liquid metal lubricant. Their melting points are higher than room temperature and it is therefore desirable that the lubricant made of one of them is previously heated to a temperature higher than its melting point and thus liquified before the anode target is rotated.

According to the present invention as described above, there can be provided a rotary X-ray tube of the anode type whose bearing surfaces made of ceramics are more good in becoming-wet capacity relative to the liquid metal lubricant and more hardly eroded by the lubricant and which has a more stable bearing capacity over a longer time. In addition, bearing base material, relatively lower in cost, can be used.

What is claimed is:

1. A rotary anode type x-ray tube comprising:

an anode target;

a rotary structure having one end to which the anode target is fixed;

a stationary structure for holding the rotary structure;

a sliding bearing section including bearing surface which are partly formed on the rotary and stationary structures and provided with spiral grooves formed thereon and a bearing gap between the bearing surfaces of the rotary an stationary structures; and a metal lubricant for allowing the rotary structure to be smoothly rotated, applied to the bearing gap and kept liquid when the x-ray tube is operated;

wherein the bearing surface or surfaces of at least one of the rotary and stationary structures are made of ceramics whose main component is the carbide, boride or nitoride of at least one of those transition metals, except chromium, which belong to a Group IVA, VA or VIA of a period 4, 5 or 6 of the Periodic Table.

2. The rotary anode type X-ray tube according to claim 1, wherein thin film made of one of the ceramics defined above is bonded onto surfaces of the rotary and stationary structures whose base material is metal to form the bearing surfaces.

3. The rotary anode type X-ray tube according to claim 1, wherein the bearing base material is iron alloy.

4. The rotary anode type X-ray tube according to claim 1, wherein one of the rotary and stationary structures includes a cylinder section having the bearing surface and an opening and a disk section for substantially closing the opening of the cylinder section, thin ceramic film being bonded to the bearing surface of the cylinder section.

* * * * *